US010356498B2

(12) United States Patent
Yoon et al.

(10) Patent No.: US 10,356,498 B2
(45) Date of Patent: Jul. 16, 2019

(54) ELECTRONIC DEVICE HAVING SIDE ACOUSTIC EMISSION SPEAKER DEVICE

(71) Applicant: SAMSUNG ELECTRONICS CO., LTD., Suwon-si, Gyeonggi-do (KR)

(72) Inventors: Changshik Yoon, Seoul (KR); Sunyoung Lee, Suwon-si (KR); Byounghee Lee, Seoul (KR); Janghoon Kang, Seoul (KR); Hochul Hwang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 44 days.

(21) Appl. No.: 15/423,808

(22) Filed: Feb. 3, 2017

(65) Prior Publication Data

US 2017/0245032 A1 Aug. 24, 2017

(30) Foreign Application Priority Data

Feb. 19, 2016 (KR) ..... 10-2016-0019853

(51) Int. Cl.

| | |
|---|---|
| ***H04R 1/02*** | (2006.01) |
| ***H04R 1/34*** | (2006.01) |
| ***H04R 1/44*** | (2006.01) |

(52) U.S. Cl.

CPC ..... *H04R 1/025* (2013.01); *H04R 1/345* (2013.01); *H04R 1/44* (2013.01); *H04R 2499/11* (2013.01)

(58) Field of Classification Search

CPC .. H04R 2499/15; H04R 1/44; H04R 2499/11; H04R 1/025; H04R 1/02; H04R 1/026; H04R 1/345; H04R 1/2892; H04R 1/2896; H04R 1/086

See application file for complete search history.

(56) References Cited

U.S. PATENT DOCUMENTS

| | | | | |
|---|---|---|---|---|
| 9,154,865 | B2 * | 10/2015 | Zha | H04R 1/021 |
| 9,307,314 | B2 | 4/2016 | Kim et al. | |
| 9,363,589 | B2 * | 6/2016 | Lippert | H04R 1/023 |

(Continued)

FOREIGN PATENT DOCUMENTS

| | | | | |
|---|---|---|---|---|
| JP | 2005184422 | * | 7/2005 | H04R 9/08 |
| KP | 10-1236057 | | 2/2013 | |
| KR | 10-2014-0145068 | | 12/2014 | |

*Primary Examiner* — Oyesola C Ojo

(74) *Attorney, Agent, or Firm* — Nixon & Vanderhye P.C.

(57) ABSTRACT

The present disclosure relates to an electronic device having a side acoustic emission speaker. The electronic device may include a speaker module accommodated in the electronic device. The speaker module may include a first substrate, a speaker having a lower surface formed on the first substrate, a waterproof member contacting at least one part of an upper surface and at least one part of a first side surface of the speaker, and a second substrate contacting a second side surface of the speaker and overlapping the upper surface of the speaker. The second substrate may include a first subarea displaced from the upper surface of the speaker by a first distance and having a first thickness and a second subarea displaced from the upper surface of the speaker by a second distance and having a second thickness. A space disposed between the waterproof member and the first subarea may include an acoustic emission hole configured to transfer a sound emitted by the speaker to the outside of the electronic device.

17 Claims, 13 Drawing Sheets

(56) References Cited

U.S. PATENT DOCUMENTS

| | | | | |
|---|---|---|---|---|
| 9,414,140 | B2 * | 8/2016 | Wang | H04R 1/021 |
| 9,832,565 | B2 * | 11/2017 | Zhang | H04R 1/2803 |
| 2001/0036264 | A1 * | 11/2001 | Ito | H04B 1/385<br>379/433.1 |
| 2004/0081325 | A1 * | 4/2004 | Rautio | H04M 1/03<br>381/189 |
| 2005/0014537 | A1 * | 1/2005 | Gammon | H04M 1/035<br>455/575.1 |
| 2007/0034493 | A1 * | 2/2007 | Kawasaki | H01H 13/86<br>200/302.2 |
| 2012/0188690 | A1 * | 7/2012 | Aihara | G03B 17/08<br>361/679.01 |
| 2013/0094685 | A1 * | 4/2013 | Seo | H04R 1/021<br>381/332 |
| 2013/0223655 | A1 * | 8/2013 | Lee | H04M 1/035<br>381/189 |
| 2014/0369533 | A1 * | 12/2014 | Kim | H04R 1/345<br>381/160 |
| 2015/0163572 | A1 * | 6/2015 | Weiss | H04R 1/02<br>381/337 |
| 2016/0088385 | A1 * | 3/2016 | Fan | H04R 1/02<br>381/352 |

* cited by examiner

ELECTRONIC DEVICE HAVING SIDE ACOUSTIC EMISSION SPEAKER DEVICE

CROSS-REFERENCE TO RELATED APPLICATION

This application is based on and claims priority under 35 U.S.C. § 119 to a Korean patent application filed on Feb. 19, 2016, in the Korean Intellectual Property Office and assigned Serial No. 10-2016-0019853, the disclosure of which is incorporated by reference herein in its entirety.

TECHNICAL FIELD

The present disclosure relates generally to an electronic device having a side acoustic emission speaker.

BACKGROUND

Electronic devices may include a display device for outputting a screen and a speaker device for outputting a sound. As electronic devices become slim, a space for installing a speaker device in an electronic device becomes smaller. Accordingly, a slim electronic device may have a micro speaker installed at the opposite side of the display device. For example, if the display device is located at the front side of the electronic device, an acoustic emission hole may be formed at the rear side of the electronic device. If the acoustic emission hole is formed at the rear side of the electronic device, acoustic characteristics may not be greatly influenced in a low-frequency sound range because the low-frequency sound range is easily diffracted. However, the acoustic characteristics in a high-frequency sound range may be deteriorated at the front side of the electronic device where a user is located because the high-frequency sound range has a high linear directivity. In order to avoid such a deterioration of acoustic characteristics, a side acoustic emission speaker device can be provided.

Recently, the environment in which electronic devices are used has expanded to seashores and swimming pools. Therefore efforts to provide a waterproof function as a default have been made to prevent water penetration, and development and research for structures of electronic devices that have a waterproof function are continuing.

However, the addition of structures for a waterproof function may cause a deterioration in the acoustic characteristics of an electronic device having a side acoustic emission speaker device.

SUMMARY

Various example embodiments of the present disclosure provide an electronic device having a side acoustic emission speaker device that can prevent and/or reduce the issue of deteriorating acoustic characteristics when structures for a waterproof function are added.

The electronic device according to various example embodiments of the present disclosure may include a speaker module accommodated in the electronic device. The speaker module may include a first substrate, a speaker having a lower surface disposed on the first substrate, a waterproof member contacting at least one part of an upper surface of the speaker and at least one part of a first side surface of the speaker, and a second substrate contacting a second side surface of the speaker and overlapping the upper surface of the speaker. The second substrate may include a first subarea spaced apart from the upper surface of the speaker by a first distance, the first subarea having a first thickness, and a second subarea spaced apart from the upper surface of the speaker by a second distance, the second subarea having a second thickness. A space between the waterproof member and the first subarea may include an acoustic emission hole configured to transfer a sound emitted by the speaker to the outside of the electronic device.

The electronic device according to various example embodiments of the present disclosure may include a speaker module accommodated in the electronic device. The speaker module may include a speaker, an enclosure case configured to surround at least one part of the speaker, and a waterproof member disposed in the enclosure case and covering a side surface and a part of an upper surface of the speaker. An upper substrate of the enclosure case facing the upper surface of the speaker may be formed with a different thickness.

Various example embodiments of the present disclosure can provide a sound pressure similar to that of a conventional side emission speaker device by designing a second substrate to have different thicknesses even when a waterproof member is added. Accordingly, the issue of deteriorating acoustic characteristics can be avoided when a mechanism is added for a waterproof function.

BRIEF DESCRIPTION OF THE DRAWINGS

The above and other aspects, features, and attendant advantages of the present disclosure will be more apparent and more readily appreciated from the following detailed description, taken in conjunction with the accompanying drawings, in which like reference numerals refer to like elements, and wherein.

DETAILED DESCRIPTION

Figure 1:
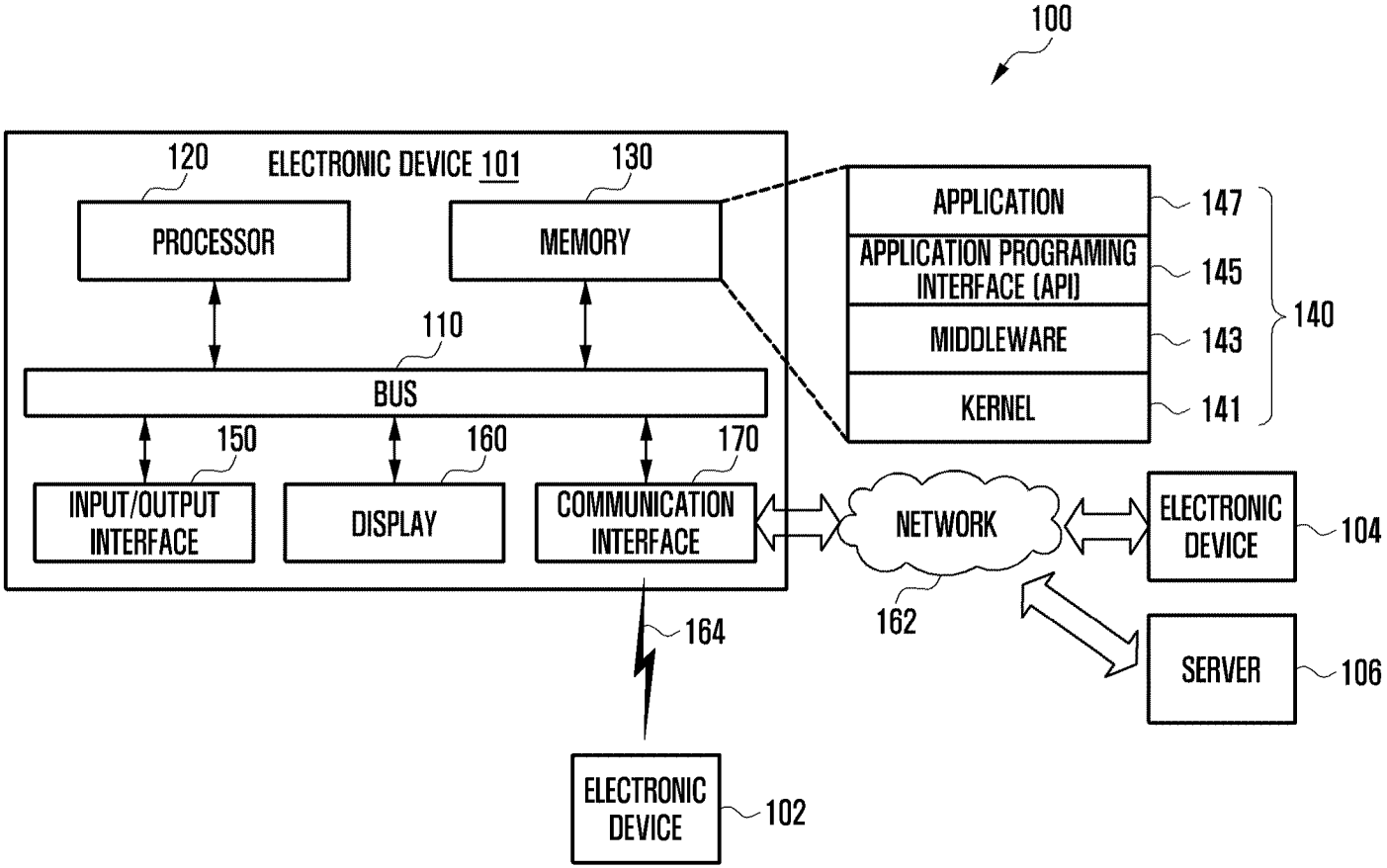
FIG. 1 is a block diagram illustrating an example electronic device in a network environment according to various example embodiments of the present disclosure.

The following detailed description with reference to the accompanying drawings is provided to assist in a comprehensive understanding of various example embodiments of the present disclosure as defined by the claims and their equivalents. It includes various specific details to assist in that understanding but these are to be regarded as merely examples. Accordingly, those of ordinary skill in the art will recognize that various changes and modifications of the various example embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various example embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The expressions such as "include" and "may include" may denote the presence of the disclosed functions, operations, and constituent elements and do not limit one or more additional functions, operations, and constituent elements. Terms such as "include" and/or "have" may be construed to denote a certain characteristic, number, operation, constituent element, component or a combination thereof, but may not be construed to exclude the existence of or a possibility of addition of one or more other characteristics, numbers, operations, constituent elements, components or combinations thereof.

Furthermore, in the present disclosure, the expression "and/or" includes any and all combinations of the associated listed words. For example, the expression "A and/or B" may include A, may include B, or may include both A and B.

In the present disclosure, expressions including ordinal numbers, such as "first" and "second," etc., may modify various elements. However, such elements are not limited by the above expressions. For example, the above expressions do not limit the sequence and/or importance of the elements. The above expressions are used merely for the purpose to distinguish an element from the other elements. For example, a first user device and a second user device indicate different user devices although both of them are user devices. For example, a first element could be termed a second element, and similarly, a second element could be also termed a first element without departing from the scope of the present disclosure.

In the case where a component is referred to as being "connected" or "accessed" to other component, it should be understood that not only the component is directly connected or accessed to the other component, but also there may exist another component between them. Meanwhile, in the case where a component is referred to as being "directly connected" or "directly accessed" to other component, it should be understood that there is no component therebetween. The terms used in the present disclosure are only used to describe specific various embodiments, and are not intended to limit the present disclosure. As used herein, the singular forms are intended to include the plural forms as well, unless the context clearly indicates otherwise. Singular forms are intended to include plural forms unless the context clearly indicates otherwise.

An electronic device according to the present disclosure may be a device including a communication function. For example, the device corresponds to a combination of at least one of a smartphone, a tablet Personal Computer (PC), a mobile phone, a video phone, an e-book reader, a desktop PC, a laptop PC, a netbook computer, a Personal Digital Assistant (PDA), a Portable Multimedia Player (PMP), adigital audio player, a mobile medical device, an electronic bracelet, an electronic necklace, an electronic accessory, a camera, a wearable device, an electronic clock, a wrist watch, home appliances (for example, an air-conditioner, vacuum, an oven, a microwave, a washing machine, an air cleaner, and the like), an artificial intelligence robot, a TeleVision (TV), a Digital Video Disk (DVD) player, an audio device, various medical devices (for example, Magnetic Resonance Angiography (MRA), Magnetic Resonance Imaging (MRI), Computed Tomography (CT), a scanning machine, a ultrasonic wave device, or the like), a navigation device, a Global Positioning System (GPS) receiver, an Event Data Recorder (EDR), a Flight Data Recorder (FDR), a set-top box, a TV box (for example, Samsung HomeSync™, Apple TV™, or Google TV™), an electronic dictionary, vehicle infotainment device, an electronic equipment for a ship (for example, navigation equipment for a ship, gyrocompass, or the like), avionics, a security device, electronic clothes, an electronic key, a camcorder, game consoles, a Head-Mounted Display (HMD), a flat panel display device, an electronic frame, an electronic album, furniture or a portion of a building/structure that includes a communication function, an electronic board, an electronic signature receiving device, a projector, or the like, but is not limited thereto. It will be apparent to those skilled in the art that the electronic device according to the present disclosure is not limited to the aforementioned devices.

FIG. 1 is a block diagram illustrating an example configuration of an example electronic device according to an example embodiment of the present disclosure.

Referring to FIG. 1, the electronic device 100 may include a bus 110, a processor (e.g., including processing circuitry) 120, a memory 130, an input/output interface (e.g., including input/output circuitry) 150 a display 160, a communication interface (e.g., including communication circuitry) 170, and other similar and/or suitable components.

The bus 110 may be a circuit which interconnects the above-described elements and delivers a communication (e.g., a control message) between the above-described elements.

The processor 120 may receive commands from the above-described other elements (e.g., the memory 130, the input/output interface 150, the display 160, the communication interface 170, etc.) through the bus 110, may interpret the received commands, and may execute calculation or data processing according to the interpreted commands.

The memory 130 may store commands or data received from the processor 120 or other elements (e.g., the input/ output interface 150, the display 160, the communication interface 170, etc.) or generated by the processor 120 or the other elements. The memory 130 may include programming modules 140, such as a kernel 141, middleware 143, an Application Programming Interface (API) 145, an application 147, and the like. Each of the above-described programming modules may be implemented in software, firmware, hardware, or a combination of two or more thereof.

The kernel 141 may control or manage system resources (e.g., the bus 110, the processor 120, the memory 130, etc.) used to execute operations or functions implemented by other programming modules (e.g., the middleware 143, the API 145, and the application 147). Also, the kernel 141 may provide an interface capable of accessing and controlling or managing the individual elements of the electronic device 100 by using the middleware 143, the API 145, or the application 147.

The middleware 143 may serve to go between the API 145 or the application 147 and the kernel 141 in such a manner that the API 145 or the application 147 communicates with the kernel 141 and exchanges data therewith. Also, in relation to work requests received from one or more applications 147 and/or the middleware 143, for example, may perform load balancing of the work requests by using a method of assigning a priority, in which system resources (e.g., the bus 110, the processor 120, the memory 130, etc.) of the electronic device 100 can be used, to at least one of the one or more applications 147.

The API 145 is an interface through which the application 147 is capable of controlling a function provided by the kernel 141 or the middleware 143, and may include, for example, at least one interface or function for file control, window control, image processing, character control, or the like.

The input/output interface 150, for example, may receive a command or data as input from a user, and may deliver the received command or data to the processor 120 or the memory 130 through the bus 110. The display 160 may display a video, an image, data, or the like to the user.

The communication interface 170 may include various communication circuitry and may connect communication between another electronic device 102 and the electronic device 100. The communication module 160 may support a predetermined short-range communication protocol 164 (e.g., Wi-Fi, BlueTooth (BT), and Near Field Communication (NFC)), or predetermined network communication 162 (e.g., the Internet, a Local Area Network (LAN), a Wide Area Network (WAN), a telecommunication network, a cellular network, a satellite network, a Plain Old Telephone Service (POTS), or the like). Each of the electronic devices 102 and 104 may be a device which is identical (e.g., of an identical type) to or different (e.g., of a different type) from the electronic device 100. Further, the communication module 160 may connect communication between a server 106 and the electronic device 100 via the network 162.

Figure 2:
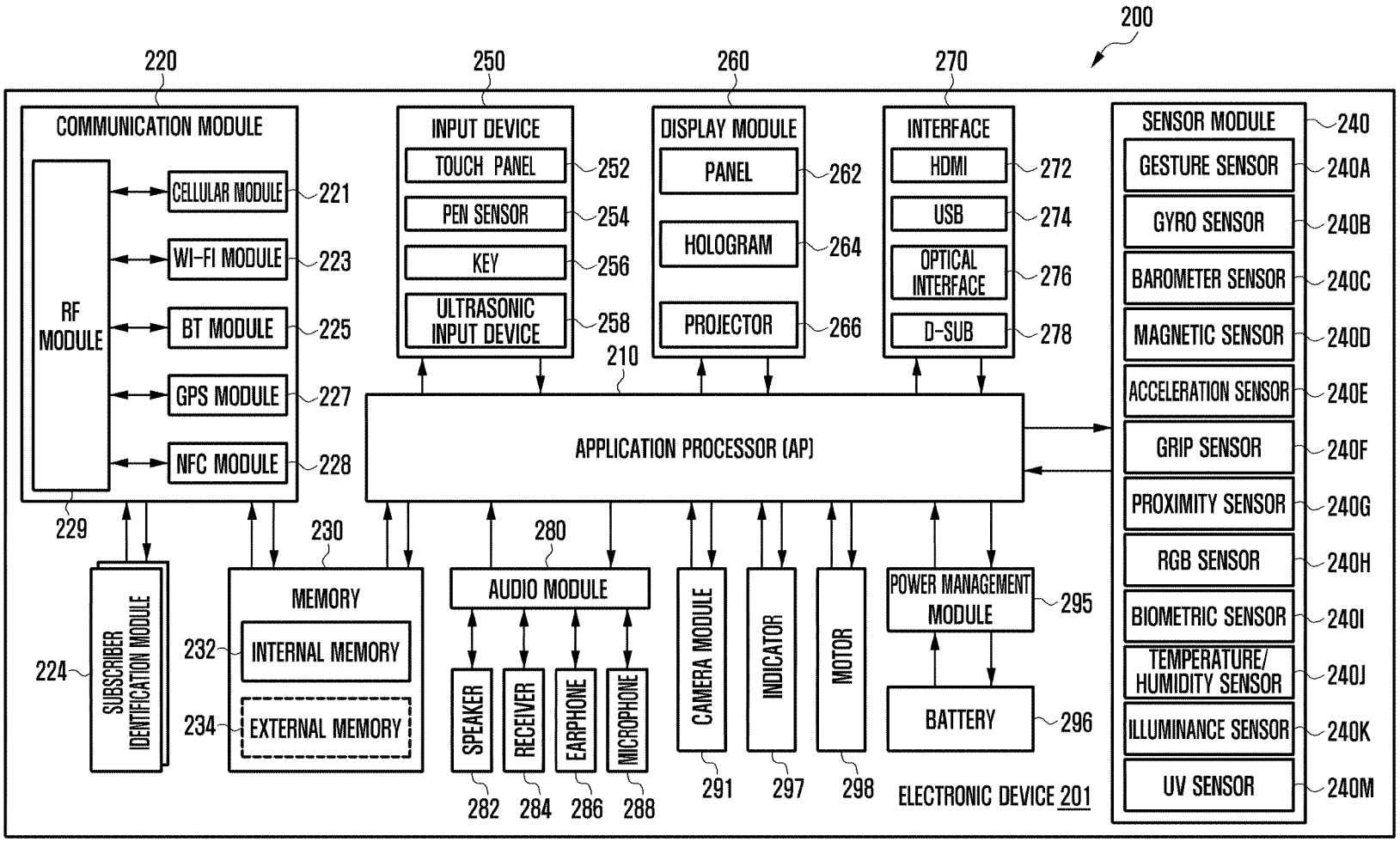
FIG. 2 is a block diagram illustrating an example configuration of an electronic device according to various example embodiments of the present disclosure.

FIG. 2 is a block diagram 200 illustrating an example configuration of an example electronic device 201 according to an example embodiment of the present disclosure.

The hardware 200 may be, for example, the electronic device 101 illustrated in FIG. 1.

Referring to FIG. 2, the electronic device may include one or more processors (e.g., including processing circuitry) 210, a communication module (e.g., including communication circuitry) 220, a Subscriber Identification Module (SIM) card 224, a memory 230, a sensor module 240, a input device (e.g., including input circuitry) 250, a display module 260, an interface (e.g., including interface circuitry) 270, an audio module 280, a camera module 291, a power management module 295, a battery 296, an indicator 297, a motor 298 and any other similar and/or suitable components.

The Application Processor (AP) 210 (e.g., the processor 120) may include various processing circuitry, such as, for example, and without limitation, one or more dedicated processors, CPUs, Application Processors (APs), or one or more Communication Processors (CPs). The processor 210 may be, for example, the processor 120 illustrated in FIG. 1. The AP 210 is illustrated as being included in the processor 210 in FIG. 2, but may be included in different Integrated Circuit (IC) packages, respectively. According to an embodiment of the present disclosure, the AP 210 may be included in one IC package.

The AP 210 may execute an Operating System (OS) or an application program, and thereby may control multiple hardware or software elements connected to the AP 210 and may perform processing of and arithmetic operations on various data including multimedia data. The AP 210 may be implemented by, for example, a System on Chip (SoC). According to an embodiment of the present disclosure, the AP 210 may further include a Graphical Processing Unit (GPU) (not illustrated).

The AP 210 may manage a data line and may convert a communication protocol in the case of communication between the electronic device (e.g., the electronic device 100) including the hardware 200 and different electronic devices connected to the electronic device through the network. The AP 210 may be implemented by, for example, a SoC. According to an embodiment of the present disclosure, the AP 210 may perform at least some of multimedia control functions. The AP 210, for example, may distinguish and authenticate a terminal in a communication network by using a subscriber identification module (e.g., the SIM card 224). Also, the AP 210 may provide the user with services, such as a voice telephony call, a video telephony call, a text message, packet data, and the like.

Further, the AP 210 may control the transmission and reception of data by the communication module 220. In FIG. 2, the elements such as the AP 220, the power management module 295, the memory 230, and the like are illustrated as elements separate from the AP 210. However, according to an embodiment of the present disclosure, the AP 210 may include at least some (e.g., the CP) of the above-described elements.

According to an embodiment of the present disclosure, the AP 210 may load, to a volatile memory, a command or data received from at least one of a non-volatile memory and other elements connected to each of the AP 210, and may process the loaded command or data. Also, the AP 210 may store, in a non-volatile memory, data received from or generated by at least one of the other elements.

The SIM card 224 may be a card implementing a subscriber identification module, and may be inserted into a slot formed in a particular portion of the electronic device 100. The SIM card 224 may include unique identification information (e.g., Integrated Circuit Card IDentifier (ICCID)) or subscriber information (e.g., International Mobile Subscriber Identity (IMSI)).

The memory 230 may include an internal memory 232 and/or an external memory 234. The memory 230 may be, for example, the memory 130 illustrated in FIG. 1. The internal memory 232 may include, for example, at least one of a volatile memory (e.g., a Dynamic RAM (DRAM), a Static RAM (SRAM), a Synchronous Dynamic RAM (SDRAM), etc.), and a non-volatile memory (e.g., a One Time Programmable ROM (OTPROM), a Programmable ROM (PROM), an Erasable and Programmable ROM (EPROM), an Electrically Erasable and Programmable ROM (EEPROM), a mask ROM, a flash ROM, a Not AND (NAND) flash memory, a Not OR (NOR) flash memory, etc.). According to an embodiment of the present disclosure, the internal memory 232 may be in the form of a Solid State Drive (SSD). The external memory 234 may further include a flash drive, for example, a Compact Flash (CF), a Secure Digital (SD), a Micro-Secure Digital (Micro-SD), a Mini-Secure Digital (Mini-SD), an extreme Digital (xD), a memory stick, or the like.

The communication module 220 may include various communication circuitry, such as, for example, and without limitation, a cellular module 221, a wireless communication module 223 or a Radio Frequency (RF) module 229. The communication module 220 may be, for example, the communication interface 170 illustrated in FIG. 1. The communication module 220 may include various communication circuitry, such as, for example, and without limitation, a Wi-Fi module 223, a BT module 225, a GPS module 227, or an NFC module 228. For example, the wireless communication module 220 may provide a wireless communication function by using a radio frequency. Additionally or alternatively, the wireless communication module 220 may include a network interface (e.g., a LAN card), a modulator/demodulator (modem), or the like for connecting the hardware 200 to a network (e.g., the Internet, a LAN, a WAN, a telecommunication network, a cellular network, a satellite network, a POTS, or the like).

The RF module 229 may be used for transmission and reception of data, for example, transmission and reception of RF signals or called electronic signals. Although not illustrated, the RF unit 229 may include, for example, a transceiver, a Power Amplifier Module (PAM), a frequency filter, a Low Noise Amplifier (LNA), or the like. Also, the RF module 229 may further include a component for transmitting and receiving electromagnetic waves in a free space in a wireless communication, for example, a conductor, a conductive wire, or the like.

The sensor module 240 may include, for example, at least one of a gesture sensor 240A, a gyro sensor 240B, an barometer sensor 240C, a magnetic sensor 240D, an acceleration sensor 240E, a grip sensor 240F, a proximity sensor 240G, a Red, Green and Blue (RGB) (e.g., color) sensor 240H, a biometric sensor 240I, a temperature/humidity sensor 240J, an illuminance sensor 240K, and a Ultra Violet (UV) sensor 240M. The sensor module 240 may measure a physical quantity or may sense an operating state of the electronic device 100, and may convert the measured or sensed information to an electrical signal. Additionally/alternatively, the sensor module 240 may include, for example, an E-nose sensor (not illustrated), an ElectroMyoGraphy (EMG) sensor (not illustrated), an ElectroEncephaloGram (EEG) sensor (not illustrated), an ElectroCardioGram (ECG) sensor (not illustrated), a fingerprint sensor (not illustrated), and the like. Additionally or alternatively, the sensor module 240 may include, for example, an E-nose sensor (not illustrated), an EMG sensor (not illustrated), an EEG sensor (not illustrated), an ECG sensor (not illustrated), a fingerprint sensor, and the like. The sensor module 240 may further include a control circuit (not illustrated) for controlling one or more sensors included therein.

The input device 250 may include various input circuitry, such as, for example, and without limitation, a touch panel 252, a pen sensor 254 (e.g., a digital pen sensor), keys 256, and an ultrasonic input unit 258. The input device 250 may be, for example, the user input module 140 illustrated in FIG. 1. The touch panel 252 may recognize a touch input in at least one of, for example, a capacitive scheme, a resistive scheme, an infrared scheme, and an acoustic wave scheme. Also, the touch panel 252 may further include a controller (not illustrated). In the capacitive type, the touch panel 252 is capable of recognizing proximity as well as a direct touch. The touch panel 252 may further include a tactile layer (not illustrated). In this event, the touch panel 252 may provide a tactile response to the user.

The pen sensor 254 (e.g., a digital pen sensor), for example, may be implemented by using a method identical or similar to a method of receiving a touch input from the user, or by using a separate sheet for recognition. For example, a key pad or a touch key may be used as the keys 256. The ultrasonic input unit 258 enables the terminal to sense a sound wave by using a microphone (e.g., a microphone 288) of the terminal through a pen generating an ultrasonic signal, and to identify data. The ultrasonic input unit 258 is capable of wireless recognition. According to an embodiment of the present disclosure, the hardware 200 may receive a user input from an external device (e.g., a network, a computer, or a server), which is connected to the communication module 230, through the communication module 230.

The display module 260 may include a panel 262, a hologram 264, or projector 266. The display module 260 may be, for example, the display 160 illustrated in FIG. 1. The panel 262 may be, for example, a Liquid Crystal Display (LCD) and an Active Matrix Organic Light Emitting Diode (AM-OLED) display, or the like, but is not limited thereto. The panel 262 may be implemented so as to be, for example, flexible, transparent, or wearable. The panel 262 may include the touch panel 252 and one module. The hologram 264 may display a three-dimensional image in the air by using interference of light. According to an embodiment of the present disclosure, the display module 260 may further include a control circuit for controlling the panel 262 or the hologram 264.

The interface 270 may include various interface circuitry, such as, for example, and without limitation, a High-Definition Multimedia Interface (HDMI) 272, a Universal Serial Bus (USB) 274, an optical interface 276, and a D-subminiature (D-sub) 278. Additionally or alternatively, the interface 270 may include, for example, SD/Multi-Media Card (MMC) (not illustrated) or Infrared Data Association (IrDA) (not illustrated).

The audio module 280 may include an audio codec configured to bidirectionally convert between a voice and an electrical signal. The audio codec 280 may convert voice information, which is input to or output from the audio codec 280, through, for example, a speaker 282, a receiver 284, an earphone 286, the microphone 288 or the like.

The camera module 291 may capture an image and a moving image. According to an embodiment, the camera module 291 may include one or more image sensors (e.g., a front lens or a back lens), an Image Signal Processor (ISP) (not illustrated), and a flash LED (not illustrated).

The power management module 295 may manage power of the hardware 200.

Although not illustrated, the power management module 295 may include, for example, a Power Management Integrated Circuit (PMIC), a charger Integrated Circuit (IC), or a battery fuel gauge.

The PMIC may be mounted to, for example, an IC or a SoC semiconductor. Charging methods may be classified into a wired charging method and a wireless charging method. The charger IC may charge a battery, and may prevent an overvoltage or an overcurrent from a charger to the battery. According to an embodiment of the present disclosure, the charger IC may include a charger IC for at least one of the wired charging method and the wireless charging method. Examples of the wireless charging method may include a magnetic resonance method, a magnetic induction method, an electromagnetic method, and the like. Additional circuits (e.g., a coil loop, a resonance circuit, a rectifier, etc.) for wireless charging may be added in order to perform the wireless charging.

The battery fuel gauge may measure, for example, a residual quantity of the battery 296, or a voltage, a current or a temperature during the charging. The battery 296 may supply power by generating electricity, and may be, for example, a rechargeable battery.

The indicator 297 may indicate particular states of the hardware 200 or a part (e.g., the AP 211) of the hardware 200, for example, a booting state, a message state, a charging state and the like. The motor 298 may convert an electrical signal into a mechanical vibration. The processor 210 may control the sensor module 240.

Although not illustrated, the hardware 200 may include a processing unit (e.g., a GPU) for supporting a module TV. The processing unit for supporting a module TV may process media data according to standards such as, for example, Digital Multimedia Broadcasting (DMB), Digital Video Broadcasting (DVB), media flow, and the like. Each of the above-described elements of the hardware 200 according to an embodiment of the present disclosure may include one or more components, and the name of the relevant element may change depending on the type of electronic device. The hardware 200 according to an embodiment of the present disclosure may include at least one of the above-described elements. Some of the above-described elements may be omitted from the hardware 200, or the hardware 200 may further include additional elements. Also, some of the elements of the hardware 200 according to an embodiment of the present disclosure may be combined into one entity, which may perform functions identical to those of the relevant elements before the combination.

The term "module" used in the present disclosure may refer to, for example, a unit including one or more combinations of hardware, software, and firmware. The "module" may be interchangeable with a term, such as "unit," "logic," "logical block," "component," "circuit," or the like. The "module" may be a minimum unit of a component formed as one body or a part thereof. The "module" may be a minimum unit for performing one or more functions or a part thereof. The "module" may be implemented mechanically or electronically. For example, the "module" according to an embodiment of the present disclosure may include at least one of a dedicated processor, a CPU, an Application-Specific Integrated Circuit (ASIC) chip, a Field-Programmable Gate Array (FPGA), and a programmable-logic device for performing certain operations which have been known or are to be developed in the future.

Figure 3:
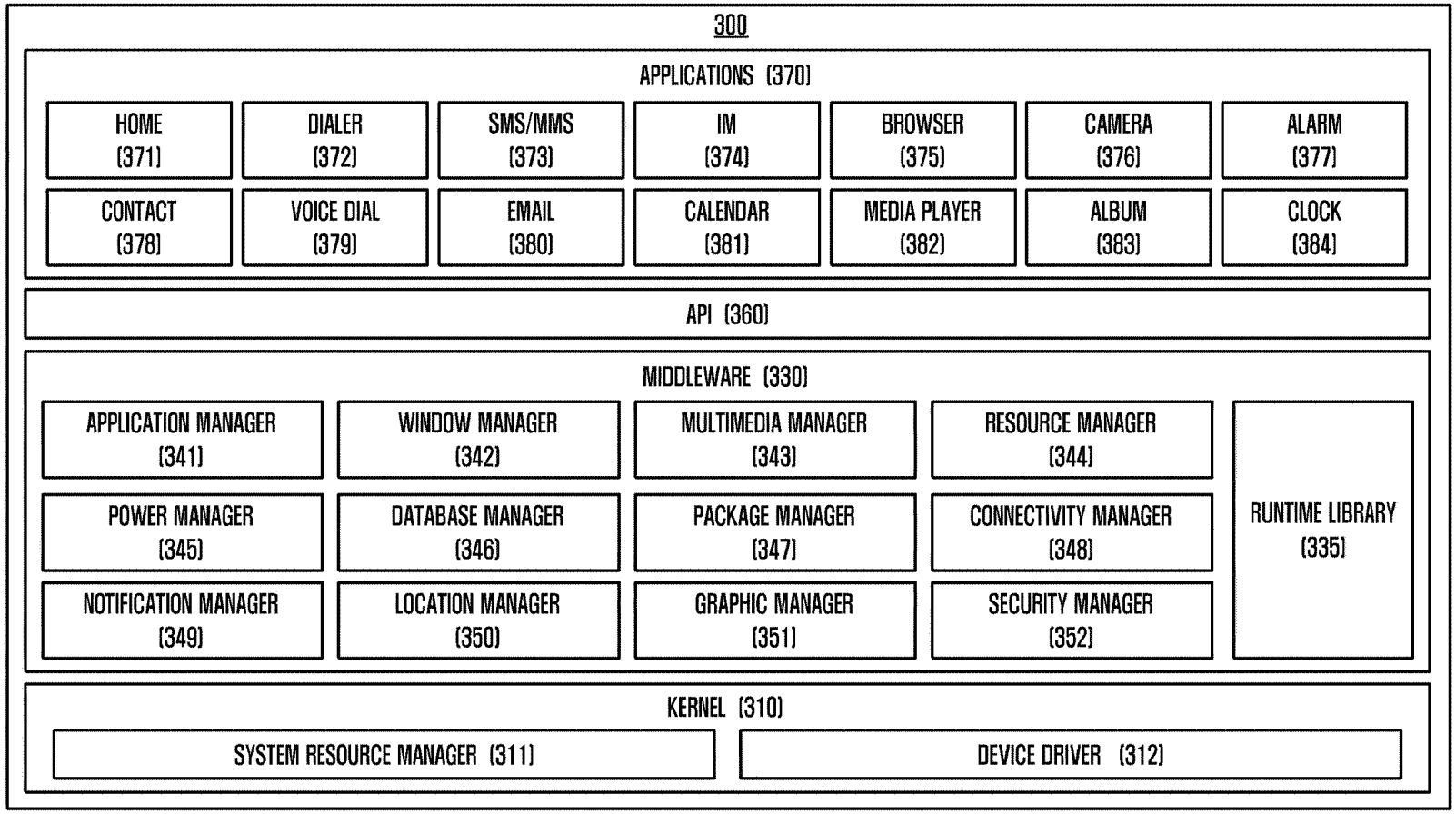
FIG. 3 is a block diagram illustrating an example configuration of a program module according to various example embodiments of the present disclosure.

FIG. 3 is a block diagram illustrating a configuration of an example programming module 300 according to an example embodiment of the present disclosure.

The programming module 300 may be included (or stored) in the electronic device 100 (e.g., the memory 130) or may be included (or stored) in the electronic device 200 (e.g., the memory 230) illustrated in FIG. 1. At least a part of the programming module 300 may be implemented in software, firmware, hardware, or a combination of two or more thereof. The programming module 300 may be implemented in hardware (e.g., the hardware 200), and may include an OS controlling resources related to an electronic device (e.g., the electronic device 100) and/or various applications (e.g., an application 370) executed in the OS. For example, the OS may be Android, iOS, Windows, Symbian, Tizen, Bada, and the like.

Referring to FIG. 3, the programming module 300 may include a kernel 310, a middleware 330, an API 360, and/or the application 370.

The kernel 310 (e.g., the kernel 141) may include a system resource manager 311 and/or a device driver 312. The system resource manager 311 may include, for example, a process manager (not illustrated), a memory manager (not illustrated), and a file system manager (not illustrated). The system resource manager 311 may perform the control, allocation, recovery, and/or the like of system resources. The device driver 312 may include, for example, a display driver (not illustrated), a camera driver (not illustrated), a Bluetooth driver (not illustrated), a shared memory driver (not illustrated), a USB driver (not illustrated), a keypad driver (not illustrated), a Wi-Fi driver (not illustrated), and/or an audio driver (not illustrated). Also, according to an embodiment of the present disclosure, the device driver 312 may include an Inter-Process Communication (IPC) driver (not illustrated).

The middleware 330 may include multiple modules previously implemented so as to provide a function used in common by the applications 370. Also, the middleware 330 may provide a function to the applications 370 through the API 360 in order to enable the applications 370 to efficiently use limited system resources within the electronic device. For example, as illustrated in FIG. 3, the middleware 330 (e.g., the middleware 143) may include at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, a security manager 352, and any other suitable and/or similar manager.

The runtime library 335 may include, for example, a library module used by a complier, in order to add a new function by using a programming language during the execution of the application 370. According to an embodiment of the present disclosure, the runtime library 335 may perform functions which are related to input and output, the management of a memory, an arithmetic function, and/or the like.

The application manager 341 may manage, for example, a life cycle of at least one of the applications 370. The window manager 342 may manage GUI resources used on the screen. The multimedia manager 343 may detect a format used to reproduce various media files and may encode or decode a media file through a codec appropriate for the relevant format. The resource manager 344 may manage resources, such as a source code, a memory, a storage space, and/or the like of at least one of the applications 370.

The power manager 345 may operate together with a Basic Input/Output System (BIOS), may manage a battery or power, and may provide power information and the like used for an operation. The database manager 346 may manage a database in such a manner as to enable the generation, search and/or change of the database to be used by at least one of the applications 370. The package manager 347 may manage the installation and/or update of an application distributed in the form of a package file.

The connectivity manager 348 may manage a wireless connectivity such as, for example, Wi-Fi and Bluetooth. The notification manager 349 may display or report, to the user, an event such as an arrival message, an appointment, a proximity alarm, and the like in such a manner as not to disturb the user. The location manager 350 may manage location information of the electronic device. The graphic manager 351 may manage a graphic effect, which is to be provided to the user, and/or a user interface related to the graphic effect. The security manager 352 may provide various security functions used for system security, user authentication, and the like. According to an embodiment of the present disclosure, when the electronic device (e.g., the electronic device 100) has a telephone function, the middleware 330 may further include a telephony manager (not illustrated) for managing a voice telephony call function and/or a video telephony call function of the electronic device.

The middleware 330 may generate and use a new middleware module through various functional combinations of the above-described internal element modules. The middleware 330 may provide modules specialized according to types of OSs in order to provide differentiated functions. Also, the middleware 330 may dynamically delete some of the existing elements, or may add new elements. Accordingly, the middleware 330 may omit some of the elements described in the various embodiments of the present disclosure, may further include other elements, or may replace the some of the elements with elements, each of which performs a similar function and has a different name.

The API 360 (e.g., the API 145) is a set of API programming functions, and may be provided with a different configuration according to an OS. In the case of Android or iOS, for example, one API set may be provided to each platform. In the case of Tizen, for example, two or more API sets may be provided to each platform.

The applications 370 (e.g., the applications 147) may include, for example, a preloaded application and/or a third party application. The applications 370 (e.g., the applications 147) may include, for example, a home application 371, a dialer application 372, a Short Message Service (SMS)/Multimedia Message Service (MMS) application 373, an Instant Message (IM) application 374, a browser application 375, a camera application 376, an alarm application 377, a contact application 378, a voice dial application 379, an electronic mail (e-mail) application 380, a calendar application 381, a media player application 382, an album application 383, a clock application 384, and any other suitable and/or similar application.

At least a part of the programming module 300 may be implemented by instructions stored in a non-transitory computer-readable storage medium. When the instructions are executed by one or more processors (e.g., the one or more processors 210), the one or more processors may perform functions corresponding to the instructions. The non-transitory computer-readable storage medium may be, for example, the memory 220. At least a part of the programming module 300 may be implemented (e.g., executed) by, for example, the one or more processors 210. At least a part of the programming module 300 may include, for example, a module, a program, a routine, a set of instructions, and/or a process for performing one or more functions.

Names of the elements of the programming module (e.g., the programming module 300) according to an embodiment of the present disclosure may change depending on the type of OS. The programming module according to an embodiment of the present disclosure may include one or more of the above-described elements. Alternatively, some of the above-described elements may be omitted from the programming module. Alternatively, the programming module may further include additional elements. The operations performed by the programming module or other elements according to an embodiment of the present disclosure may be processed in a sequential method, a parallel method, a repetitive method, or a heuristic method. Also, some of the operations may be omitted, or other operations may be added to the operations.

The electronic device according to various embodiments of the present disclosure may include a speaker module of which at least one part is accommodated in the electronic device. The speaker module may include a first substrate, a speaker of which at least one part of a lower surface is formed on the first substrate, a waterproof member formed by contacting with at least one part of an upper surface and at least one part of a first side surface of the speaker and a second substrate connected to a second side surface of the speaker and surrounding the upper surface of the speaker. The second substrate may include a first subarea displaced from the upper surface maintaining a first distance range and having a first thickness range and a second subarea displaced from the upper surface maintaining a second distance range and having a second thickness range. A space displaced between the waterproof member and the first subarea may be formed with an acoustic emission hole for transferring a sound emitted by the speaker to the outside of the electronic device. The first subarea corresponds to an end of the waterproof member covering a part of the upper surface of the speaker and to a conduit area between a sound path and a sound reflection space located on the upper surface of the speaker, and the second subarea corresponds to the inside of the sound reflection space. The first thickness range is less than or equal to the second thickness range. The first distance range is greater than or equal to the second distance range. The second substrate may be formed in a shape that the first and second subareas are combined by having a different material from each other. The first subarea may be formed with a metallic material and the second subarea is formed with a plastic extrusion material. The second substrate comprises at least one groove in the second subarea. The groove may be formed at the rear surface of the second subarea by facing the upper surface of the speaker. The groove may be formed in a shape that a plurality of grooves is arranged corresponding to the center area of the second subarea by excluding the borders of the second subarea. The second subarea facing the upper surface of the speaker is greater than the first area facing the upper surface of the speaker.

The electronic device according to various embodiments of the present disclosure may include a speaker module of which at least one part is accommodated in the electronic device. The speaker module may include a speaker, an enclosure case configured to surround at least one part of the speaker, and a waterproof member accommodated in the enclosure case and settled by covering a side surface and a part of an upper surface of the speaker. An upper substrate of the enclosure case facing the upper surface of the speaker may be formed with a different thickness.

Figure 4:
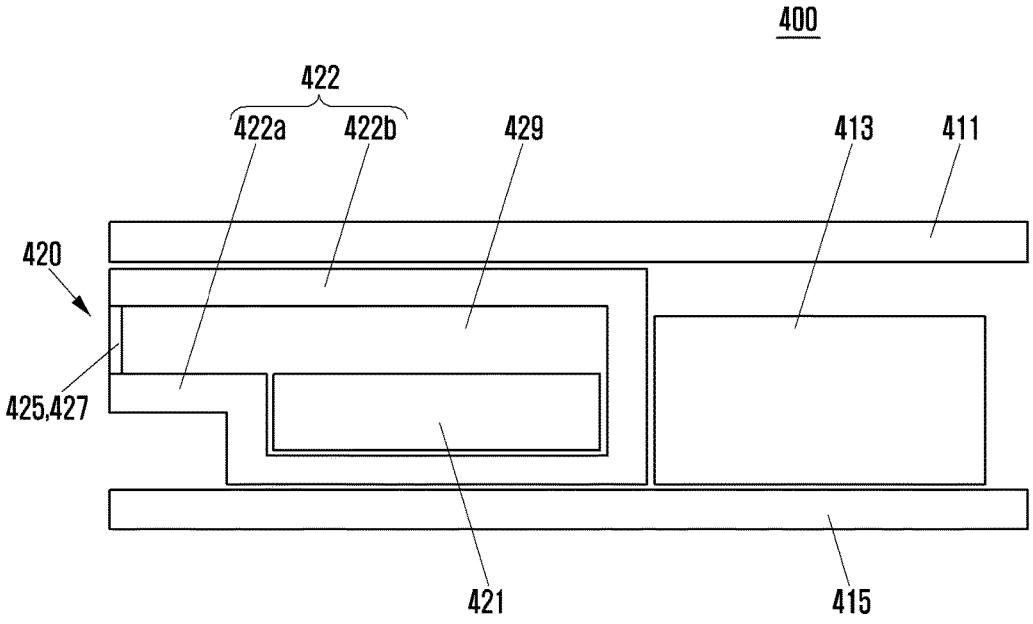
FIG. 4 is a sectional view illustrating an example electronic device according to various example embodiments of the present disclosure.

FIG. 4 is a sectional view illustrating an example electronic device according to various example embodiments of the present disclosure.

With reference to FIG. 4, the electronic device 400 may include housings 411 and 415 and a side emission speaker device 420 accommodated in the housings 411 and 415. Besides the speaker device 420, a circuit board, battery pack, integrated circuit chip, and other structures may be further included in the housings 411 and 415. Although the reference numbers 411 and 415 in FIG. 4 indicate housings, the reference numbers 411 and 415 can be a circuit board, display device, or other structures disposed in the housing. In FIG. 4, reference number 413 may be a battery pack or an integrated circuit chip. The structures accommodated in the housings 411 and 415 may be an isolating membrane for separating the side emission speaker device 420 from other components.

Hereinafter, the side emission speaker device 420 may be referred to as "speaker module 420". In various embodiments of the present disclosure, the speaker module 420 may be also replaced by the terms of a speaker, a speaker device, or any other component generating a sound in the electronic device. However, the speaker module 420 is assumed to be a speaker unit 421 or a component including all the mechanisms around the speaker unit 421.

The speaker module 420 may include a speaker 421 for generating a sound with a magnetic circuit and a vibrator, an enclosure case 422 for fixing the speaker 421 and surrounding at least one part of the speaker 421, and an acoustic emission hole 425 formed at a side of the enclosure case 422. The speaker 421 may be configured with a micro speaker. Although not shown in the drawing, the speaker module 420 may further include a "sound reflection mechanism" disclosed by a publication of Korea Patent Application 10-2014-0145068 (hereafter, reference literature), the disclosure of which is incorporated by reference herein in its entirety. The sound reflection mechanism may be formed in at least one part of an inner side surface of the enclosure case 422 to improve acoustic characteristics. The electronic device 400 according to various embodiments of the present disclosure may further include at least one component disclosed by the reference literature selectively besides the sound reflection mechanism (sound reflection surface).

The speaker 421 may include a magnetic circuit including a yoke and a magnet, a voice coil located at an air gap of the magnetic circuit, a side vibrating plate and a center vibrating plate vibrating by the voice coil, a suspension for guiding a movement of the voice coil and the vibrating plate, and a terminal pad for receiving an electric signal from the outside to transmit the electric signal to the voice coil through the suspension.

The enclosure case 422 may be configured in a separated form. For example, the enclosure case 422 may include a lower enclosure case 422*b* and an upper enclosure case 422*a*. The lower enclosure case 422*b* corresponds to the lower part of the housings 411 and 415, and may be defined as a first substrate 422*b*. The upper enclosure case 422*a* corresponds to the upper part of the housings 411 and 415 and may be defined as a second substrate 422*a*. The speaker 421 may be disposed at the inner side surface of the first substrate 422*b*. The second substrate 422*a* is located corresponding to the upper part of the speaker 421 and at least one side surface may be combined with a side surface of the first substrate 422*b*. An acoustic emission hole and sound paths 425 and 427 may be formed at the opposite side of the side surface where the first and second substrates 422*a* and 422*b* are combined. Accordingly, the acoustic emission hole and sound paths 425 and 427 may be formed at a side of the enclosure case 422, and the sound path 427 may be formed in a space where the first and second substrates 422*a* and 422*b* face each other. For example, the sound path 427 may be formed in the acoustic emission hole 425 and can be connected to a sound reflection space 429 located at the upper part of the speaker 421. A mesh may be formed at the acoustic emission hole 425 or the sound path 427. The mesh acts to prevent an inflow of foreign materials or moisture that come into the enclosure case 422 through the acoustic emission hole 425.

The speaker module 420 according to various embodiments of the present disclosure may further include a waterproof member (reference number 623 of FIG. 6) to provide a waterproof function. The waterproof member 623 is used to protect the speaker from moisture that can flow from the acoustic emission hole 425 or the sound path 427, and it can be formed with a plastic extrusion material or a metallic material in the lengthwise direction of the sound path 427. In particular, the inflow of moisture coming from the outside to the lower part of the speaker can be prevented by combining an end of the waterproof member 623 with a part of the upper surface and a part of the side surface of the speaker 421. Accordingly, by installing the waterproof member 623, malfunctions or product defects caused by the inflow of moisture into the lower part of the speaker 421 can be avoided in various embodiments of the present disclosure.

In particular, in order to prevent and/or reduce deterioration of acoustic characteristics caused by the addition of the waterproof member 623, the speaker module 420 according to various embodiments of the present disclosure may be configured by changing the thickness of the second substrate 422*a*.

Hereinafter, the speaker module according to various embodiments of the present disclosure is described in more detail.

Figure 5:
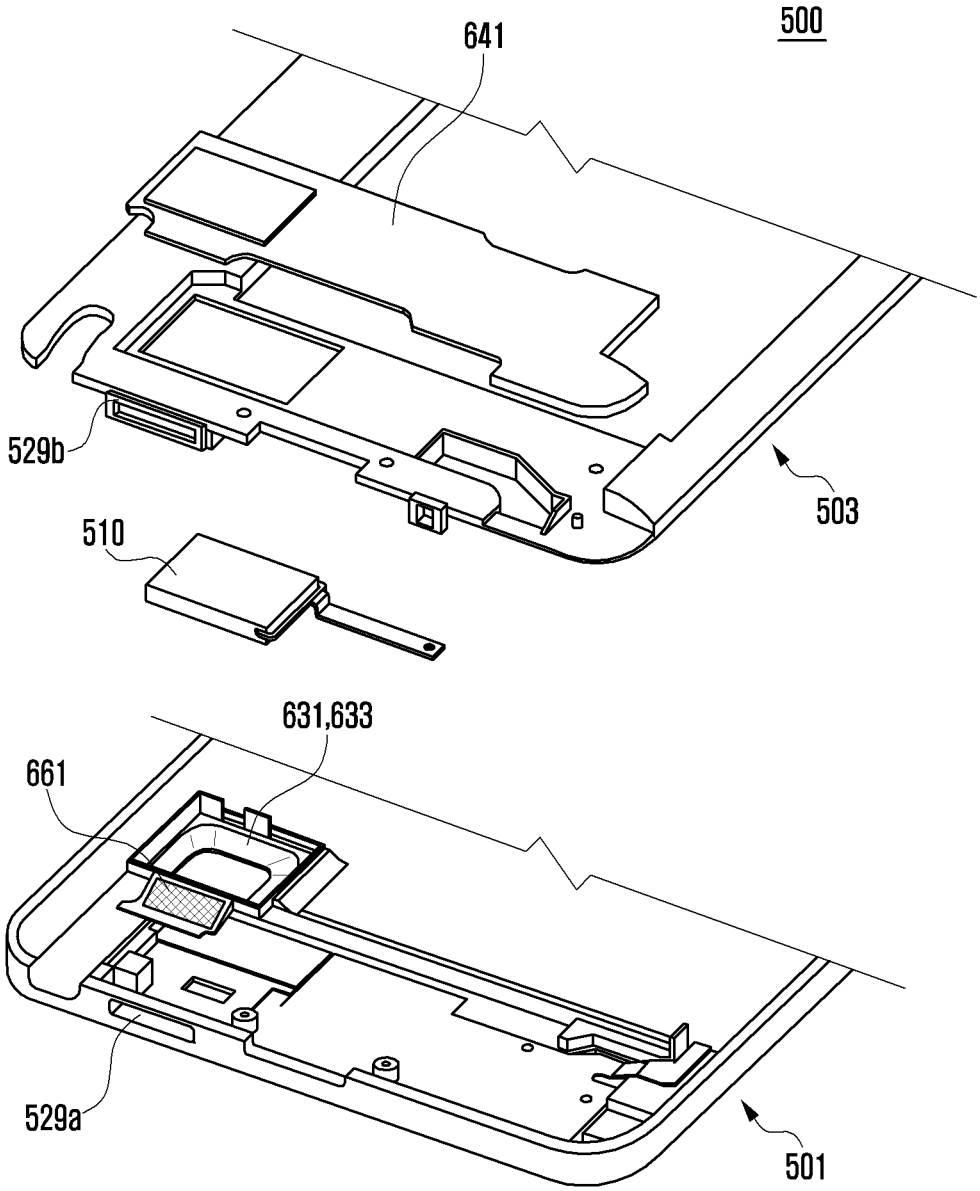
FIG. 5 is an exploded perspective view illustrating an example location of a speaker module in an electronic device according to various example embodiments of the present disclosure.
Figure 6:
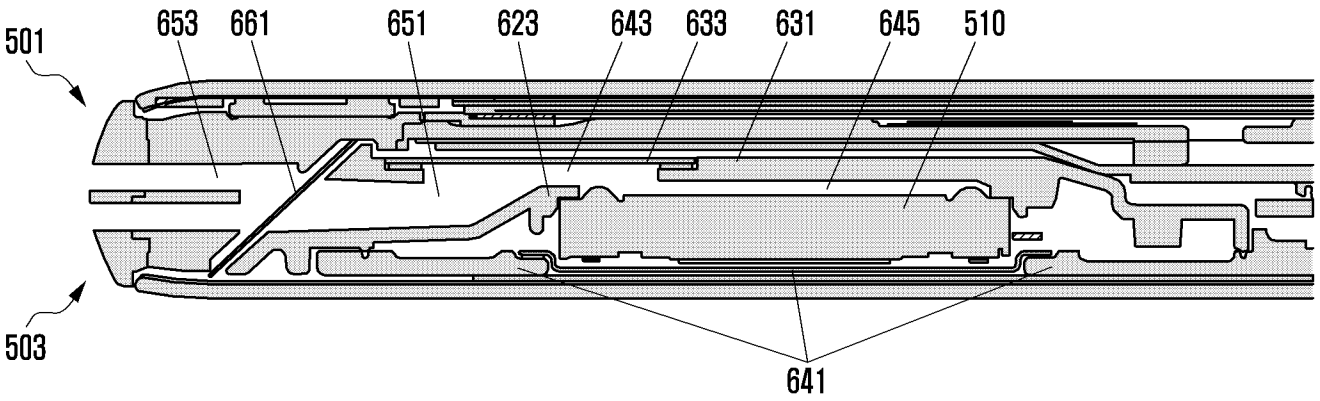
FIG. 6 is a sectional view illustrating a part of an example electronic device according to various example embodiments of the present disclosure.

FIG. 5 is an exploded perspective view illustrating a location of a speaker module in an electronic device according to various example embodiments of the present disclosure. FIG. 6 is a sectional view illustrating a part of an electronic device according to various example embodiments of the present disclosure. FIG. 6 may be a sectional view of the electronic device illustrated in FIG. 5.

With reference to FIGS. 5 and 6, the electronic device 500 may include housings 501 and 503, and a speaker module accommodated in the housings 501 and 503. Acoustic emission holes 529*a* and 529*b* are formed at a side of the housings 501 and 503, and a water proof member 623 may be formed at a sound path in the direction extended from the acoustic emission holes 529*a* and 529*b* to the speaker 510.

The housings 501 and 503 may be configured with a front case 501 and a rear case 503. An opening may be formed in the rear case 503 to accommodate (settle) at least one part of the speaker 510. For example, the speaker 510 can be accommodated in a state that a side of the speaker 510 is surrounded by the inner side wall of the opening. The acoustic emission holes 529*a* and 529*b* may be formed at a side of the housings 501 and 503 adjacent to the opening of the rear case 503. According to various embodiments of the present disclosure, the front case 501 is combined with the rear case 503 by surrounding the side surface of the rear case partially, and the acoustic emission holes 529*a* and 529*b* may include a first acoustic emission hole 529*b* formed at a side surface of the rear case 503 and a second acoustic emission hole 529*a* formed at a side surface of the front case 501.

Enclosure cases 641, 631, and 633 configured in the speaker module may be located at the inner side wall of the housings 501 and 503. For example, a first substrate 641 as an enclosure case can be combined by locating at the inner side wall of the rear case 503 of the housings 501 and 503. The first substrate 641 may be configured with a metal plate, an extrusion material, or their combinations. The second substrates 631 and 633 can be combined by locating at the inner side wall of the front case of the housings 501 and 503. The second substrates 631 and 633 may be configured with a metal plate, an extrusion material, or their combinations. A sound reflection space 645 may be formed between the speaker 510 and the second substrates 631 and 633. The sound reflection space 645 is connected to a sound path 651, and a mesh 661 may be attached to an end of the sound path 651 in order to protect against the entry of foreign materials into the enclosure cases 641, 631, and 633.

A waterproof member 623 may be further included in the sound path 651. The waterproof member 623 is used to protect the speaker 510 from moisture coming through the acoustic emission holes 529*a* and 529*b* or the sound path 651, and it may be formed with a plastic extrusion material or a metallic material in the lengthwise direction of the sound path 651. An end of the waterproof member 623 is combined with a part of the upper surface and a part of the side surface of the speaker 510 to prevent moisture flowing from the outside into the lower part of the speaker 510.

According to various embodiments, the second substrates 631 and 633 may have different thicknesses from each other to compensate for deterioration of acoustic characteristics caused by a thickness (area) change of the sound reflection space 631 according to addition of the waterproof member 623. For example, the second substrates 631 and 633 may include a first subarea 633 having a first thickness and displaced from the upper surface of the speaker 510 by maintaining a first distance, and a second subarea 631 having a second thickness and displaced from the upper surface of the speaker 510 by maintaining a second distance. The second subarea 631 may be located at a further inner part of the enclosure cases 641, 631, and 633 compared with the first subarea 633. For example, the first subarea 633 may correspond to the end of the waterproof member 623 covering a part of the upper surface of the speaker. Alternatively, the first subarea 633 may correspond to an area between the sound path 651 and the sound reflection space located at the upper surface of the speaker 510, e.g., conduit area. The second subarea 631 may correspond to an area where the waterproof member 623 is not formed, for example, an inner area where the upper surface of the speaker 510 faces the second substrates 631 and 633 directly. Alternatively, the second subarea 631 may be an area corresponding to the sound reflection space 645 located at an inner part of the sound path 651. The deterioration of acoustic characteristics can be avoided in various embodiments of the present disclosure by adjusting the thicknesses of the second substrates 631 and 633 partially and differently corresponding to the sound reflection space 645 and the sound path 651 and by minimizing an area (volume) change of the sound reflection space 645 according to addition of the waterproof member 623.

Hereinafter, the method of adjusting the thickness of the second substrates 631 and 633 and the effect of improving acoustic characteristics are described in greater detail according to various example embodiments of the present disclosure.

Figure 7A:
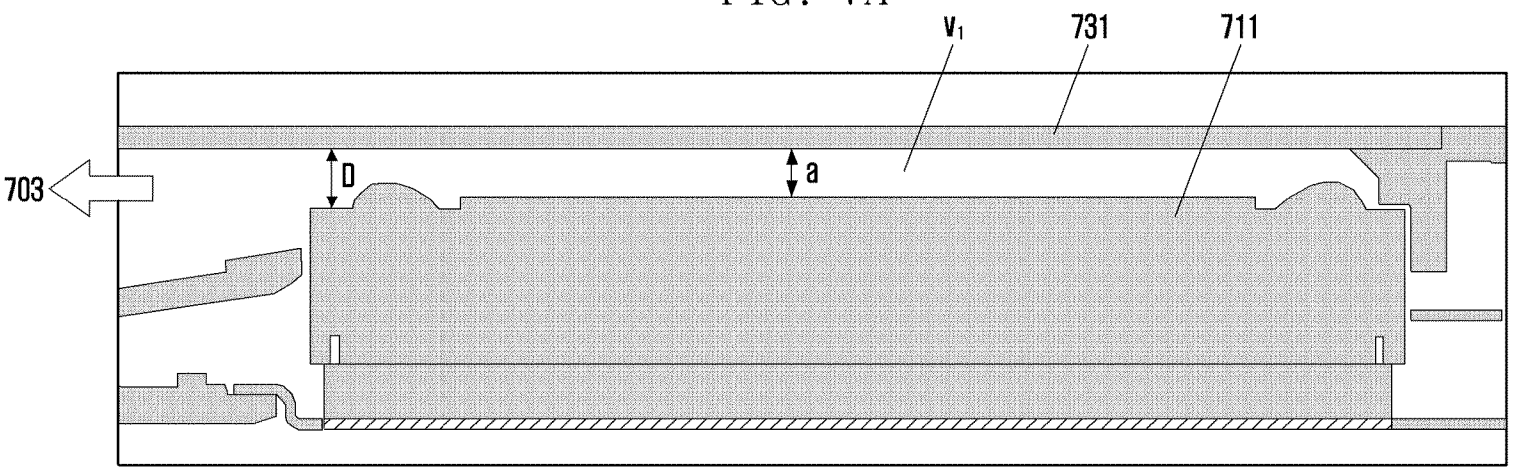
FIGS. 7A and 7B are sectional views illustrating an example acoustic characteristic deterioration of a speaker module according to addition of a waterproof member.
Figure 7B:
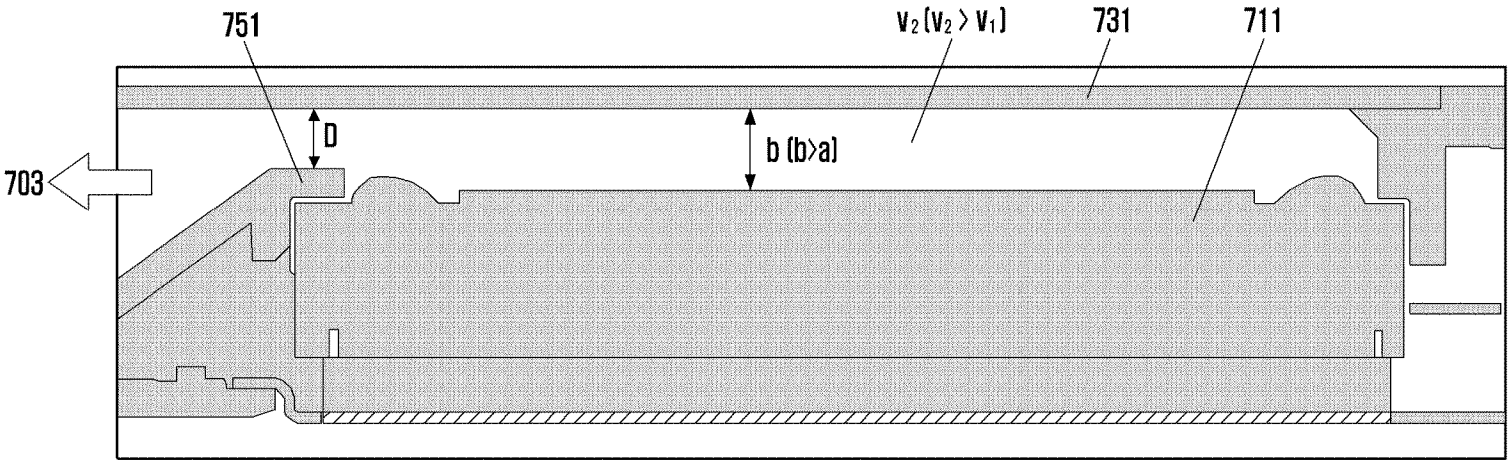
Figure 8:
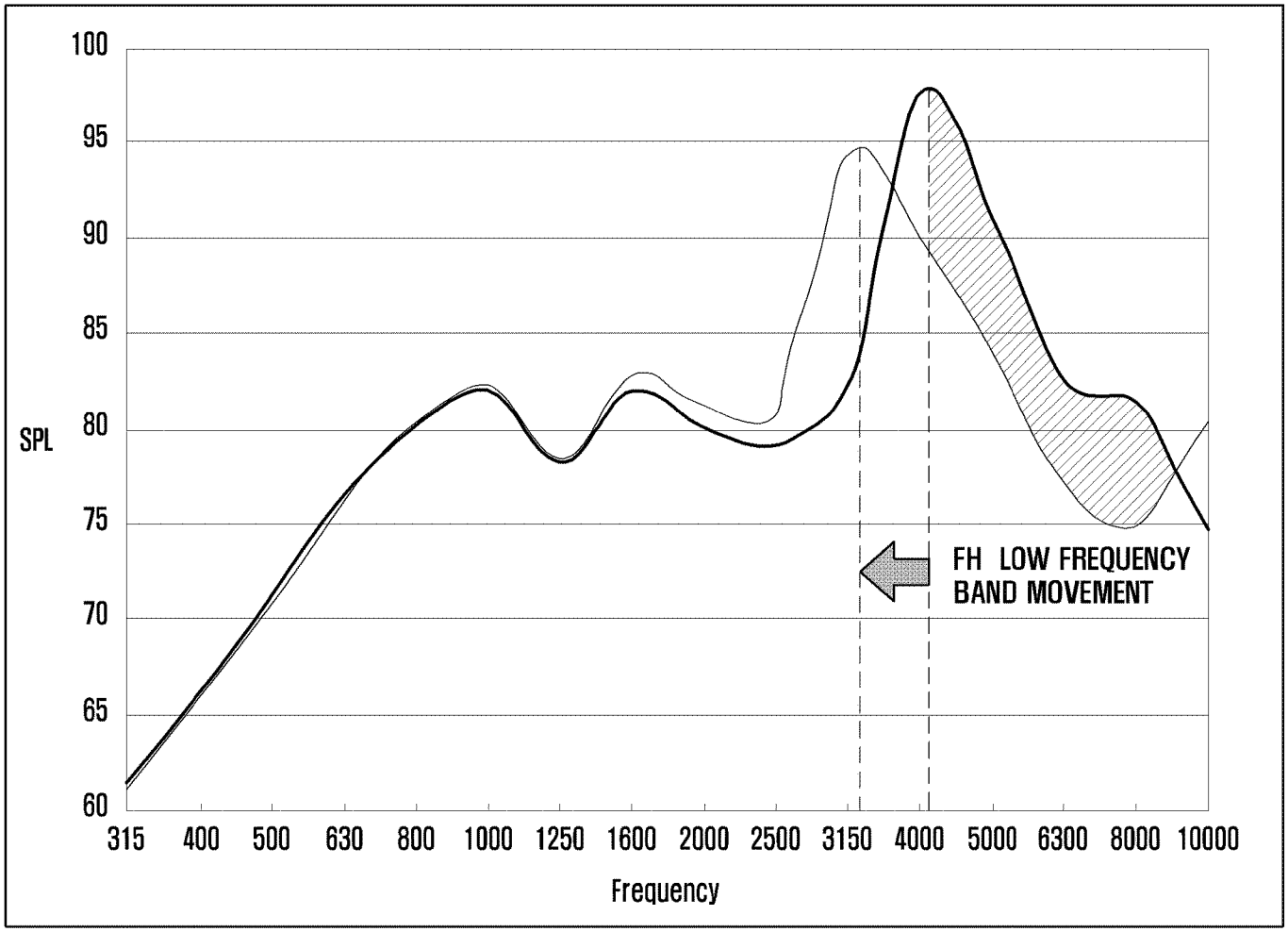
FIG. 8 is a graph illustrating an example acoustic characteristic deterioration of a speaker module according to addition of a waterproof member.

FIGS. 7A and 7B are sectional views illustrating an acoustic characteristic deterioration of a speaker module according to addition of a waterproof member. FIG. 8 is a graph illustrating an acoustic characteristic deterioration of a speaker module according to addition of a waterproof member. Reference number 703 of FIG. 7 indicates a direction of a sound path.

With reference to FIG. 7A, a speaker module having no waterproof function is formed such that an upper surface of a speaker 711 is displaced from an upper surface of a second substrate 731 by maintaining a specific distance a, and a sound reflection space V1 having a specific height (thickness) is formed between the speaker 711 and the second substrate 731. Meanwhile with reference to FIG. 7B, a speaker module having a waterproof function is formed such that a waterproof member 751 is combined with a part of the upper surface of the speaker 711 and thereby the distance b between the upper surface of the speaker 711 and the second substrate 731 becomes greater than the distance a of FIG. 7A. Accordingly, in the example of FIG. 7B, a deterioration of acoustic characteristics can be generated because of a thickness (area) change (increase) in the sound reflection space. For example, with reference to the results in FIG. 8, it is shown that a sound pressure is decreased in a high frequency band in case the sound reflection space V2 as illustrated in FIG. 7B is greater than the sound reflection space V1 as illustrated in FIG. 7A. With reference to FIG. 7B, the problem of decreasing a sound pressure in a high frequency band can be estimated by a Helmholtz resonator equation shown below.

$$f = 5410\sqrt{\frac{A}{V(l + 0.8d)}} \qquad \text{Formula 1}$$

In Formula 1, f indicates frequency, A indicates cross-sectional area of conduit, V indicates internal volume, and d indicates conduit height (thickness). With reference to Formula 1, the intention of the example of FIG. 7B is to keep a conduit height D identical to that of the conventional structure (non-waterproof structure) when a waterproof member is added; however, it is known that the internal volume V (i.e., height and volume of sound reflection space) increases. Accordingly, it can be estimated that a resonance band and a sound pressure in a high frequency band will be decreased in the example of FIG. 7B compared with that of FIG. 7A.

Figure 9:
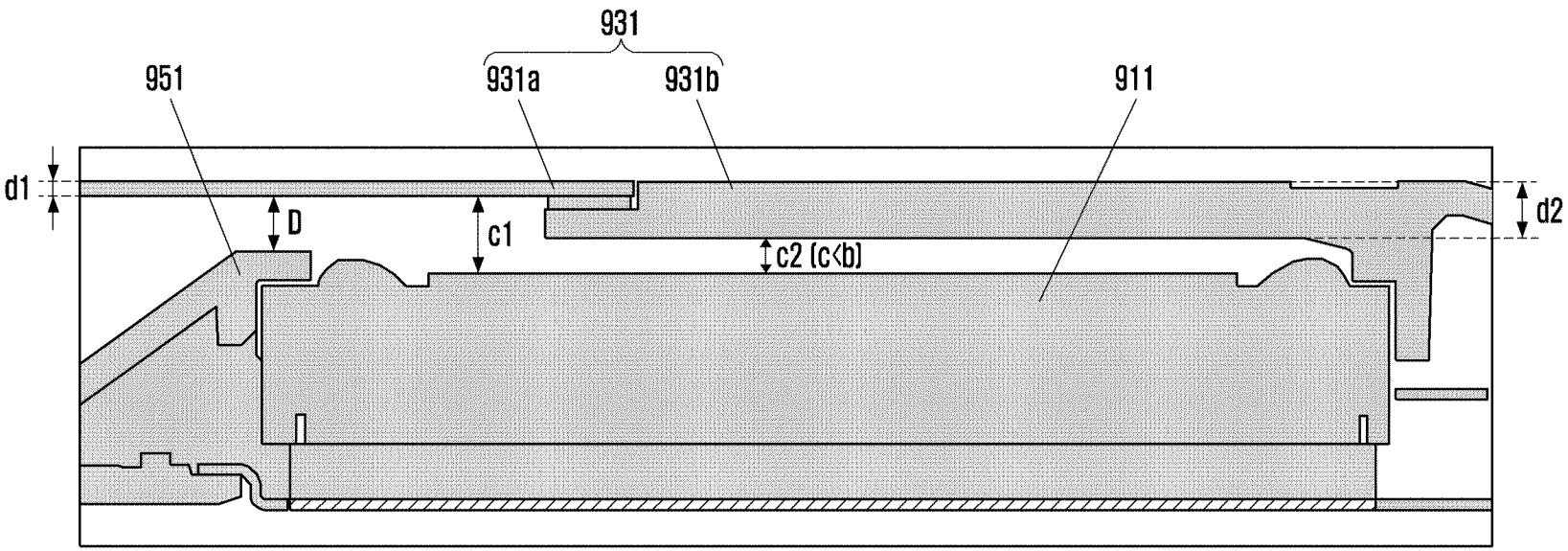
FIG. 9 is a sectional view illustrating an example speaker module according to various example embodiments of the present disclosure.
Figure 10:
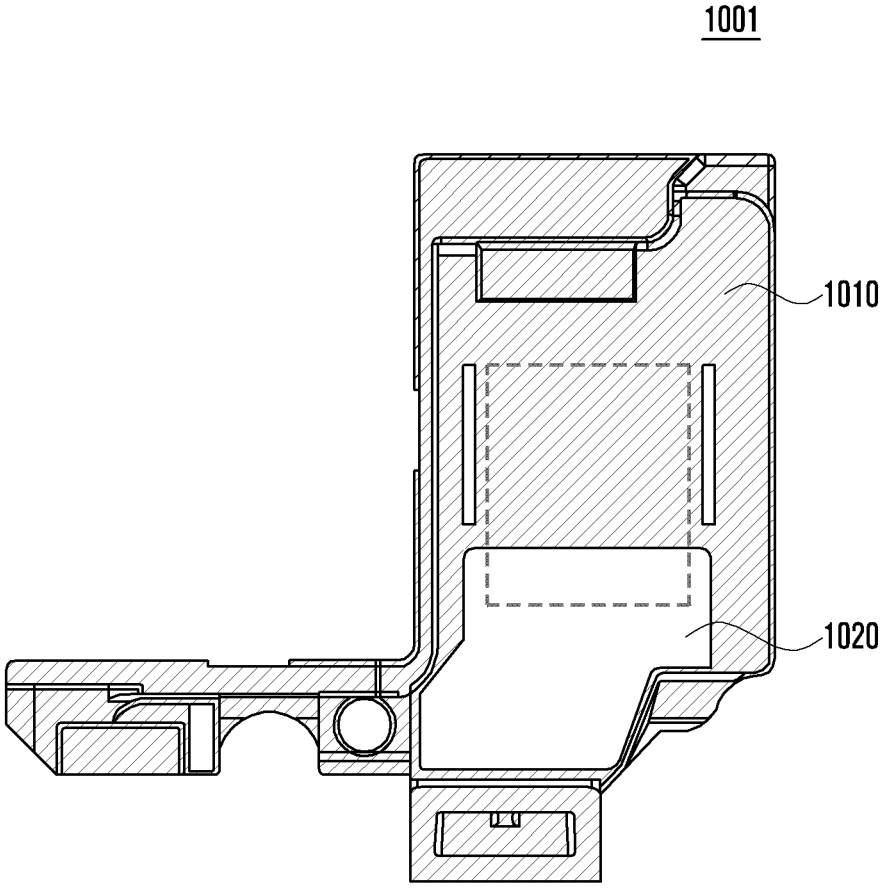
FIG. 10 is a plan view illustrating a second substrate according to various example embodiments of the present disclosure.

FIG. 9 is a sectional view illustrating an example speaker module according to various example embodiments of the present disclosure. FIG. 10 is a plan view illustrating a second substrate according to various example embodiments of the present disclosure. The speaker module illustrated in FIG. 9 may have an identical or similar configuration to the speaker module included in the electronic device illustrated in FIG. 6. The second substrate illustrated in FIG. 10 may have an identical or similar configuration to the second substrate illustrated in FIG. 9.

The speaker module according to various example embodiments of the present disclosure can prevent and/or reduce an issue of decreasing sound pressure in a high frequency band as illustrated in FIGS. 7 and 8. For example, with reference to FIG. 9, the second substrate 931 may include a first subarea 931*a* having a first thickness d1 and displaced from the upper surface of the speaker by maintaining a first distance c1 and a second subarea 931*b* having a second thickness d2 and displaced from the upper surface of the speaker by maintaining a second distance c2 (c2<b of FIG. 7B). The second subarea 931*b* may be located at a further inner portion of the enclosure case compared with the first subarea 931*a*. For example, the first subarea 931*a* may be an area corresponding to an end of the waterproof member 951 covering a part of the upper surface of the speaker 911.

According to an example embodiment, the second substrate 931 may be divided into a first subarea 931*a* and a second subarea 931*b* which have different thicknesses from each other. Further, the first and second subareas 931*a* and 931*b* of the second substrate 931 may be combined with different materials from each other. For example, the first subarea 931*a* may be configured with a metallic material such as SUS, and the second subarea 931*b* may be configured with a plastic extrusion material. The first thickness range d1 of the first subarea 931*a* may be smaller than or equal to the second thickness range d2 of the second subarea 931*b*. Accordingly, the first distance c1 between the second substrate 931 and the upper surface of the speaker 911 in the first subarea 931*a* may be greater than or equal to the second distance c2 between the second substrate 931 and the upper surface of the speaker 911 in the second subarea 931*b*. Further, the second distance c2 may be smaller than or equal to the distance b of FIG. 7B which indicates a distance between the second substrate and the upper surface of the speaker. The thickness (area or volume) of the sound reflection space of the speaker module according to the present disclosure can be reduced to a proper level compared with that of FIG. 7B, and thereby a deterioration of acoustic characteristics can be avoided. According to another embodiment, the second substrate may be configured with a single material, and the first and second subareas 931*a* and 931*b* may have different thicknesses from each other. Further, the second substrate 931 can be divided not only into the first and second subareas 931*a* and 931*b* but also into a plurality of subareas each having different thicknesses from each other. A thickness range of each subarea of the second substrate 931 can be set experimentally to have optimum acoustic characteristics by using the Helmholtz resonator equation.

According to an embodiment, the area of the second subarea 931*b* may be greater than the area of the first subarea 931*a* in the second substrate 931. The area enclosed by the dotted line in FIG. 10 indicates an area where the upper surface of the speaker 911 faces. For example, in a second substrate 1001, a second subarea 1010 configured with a plastic extrusion material facing the upper surface of the speaker may be greater than a first subarea 1020 configured with a metallic material and facing the upper surface of the speaker because thickness adjustment, in order to adjust the acoustic characteristics, is easier for a plastic extrusion material than for a metallic material. Accordingly, various embodiments of the present disclosure can provide an easier design for preventing any deterioration of acoustic characteristics while maintaining a waterproof function.

Figure 11:
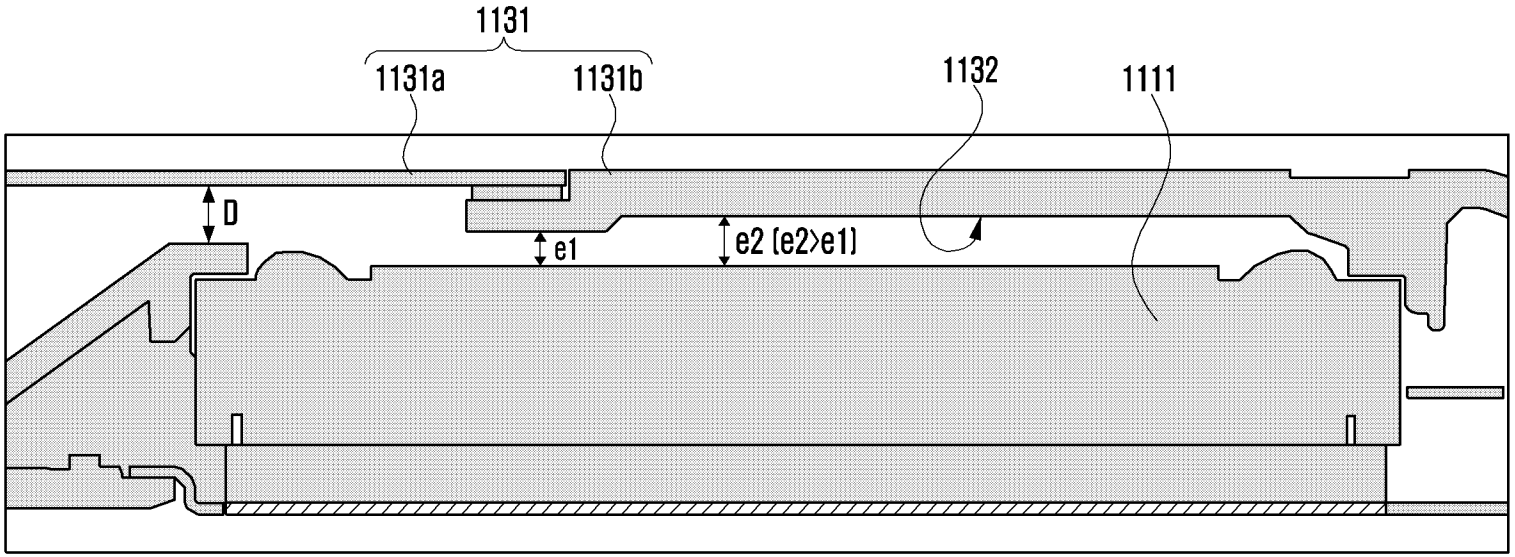
FIG. 11 is a sectional view illustrating an example speaker module according to various example embodiments of the present disclosure.

FIG. 11 is a sectional view illustrating an example speaker module according to various example embodiments of the present disclosure. FIG. 12 is a plan view illustrating a second substrate according to various example embodiments of the present disclosure.

With reference to FIGS. 11 and 12, in a speaker module according to an example embodiment, a second subarea 1131*b* of a second substrate 1131 may include at least one groove 1132 differently from the previous embodiment. For example, the second substrate 1131 may be divided into a first subarea 1131*a* and a second subarea 1131*b*, and the second subarea 1131*b* may further include at least one groove 1132. The groove provided in the second subarea 1131*b* may be formed at the second subarea 1131*b* facing an upper surface of a speaker 1111. Accordingly, a distance between the second subarea 1131*b* and the speaker 1111 may differ according to the existence of the groove. For example, in the second subarea 1131*b*, an area where the grove is not formed has a first distance e1 from the upper surface of the speaker 1111, and another area where the groove 1132 is formed has a second distance e2 (e2>e1) from the upper surface of the speaker 1111. Because of the groove 1132, the second distance e2 may be set greater than the first distance e1.

Figure 12B:
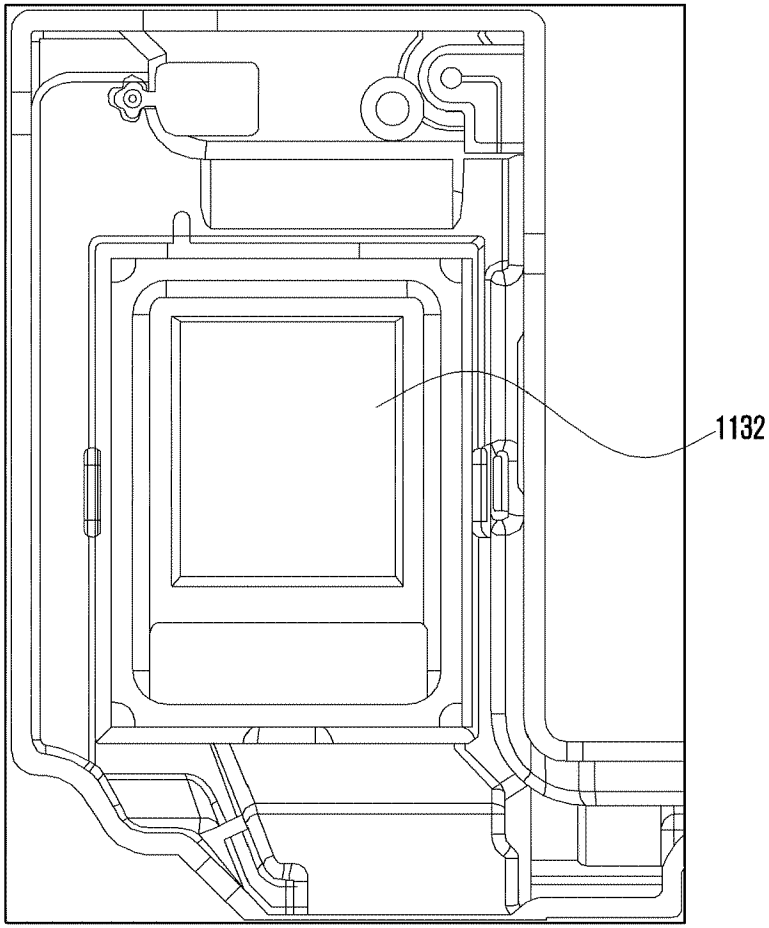
FIGS. 12A and 12B are plan views illustrating an example second substrate according to various example embodiments of the present disclosure.
Figure 12A:
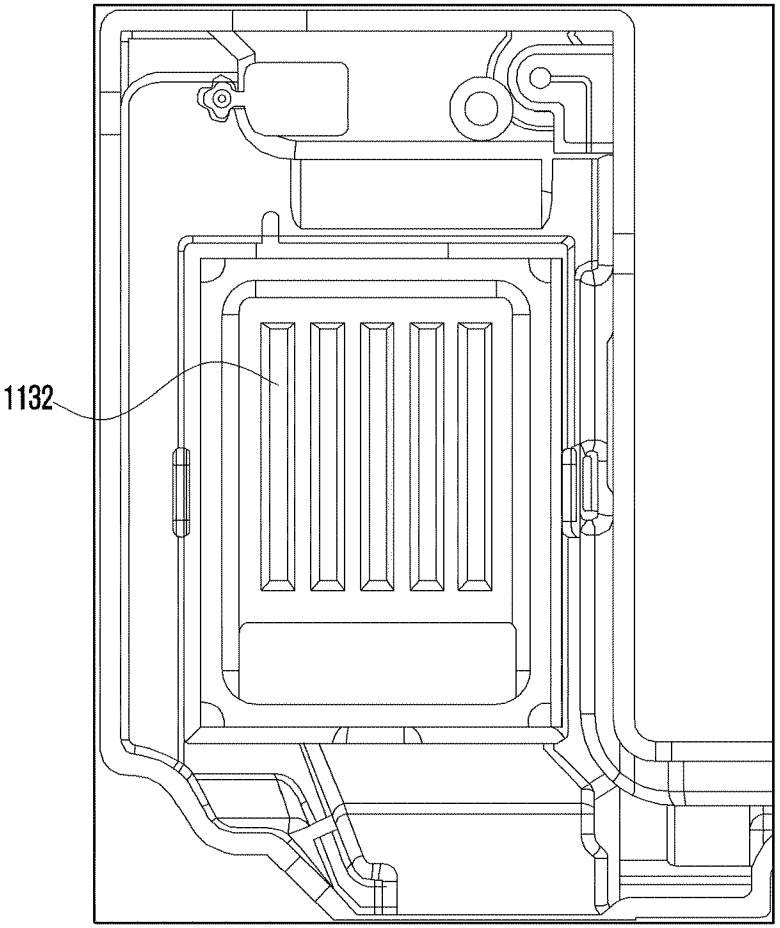

According to an embodiment, the groove 1132 may be provided in a shape that a plurality of grooves is arranged in a center area where the boarders of the second subarea are excluded as illustrated in FIG. 12A. Alternatively, the groove 1132 may be provided in a shape that a single groove is formed in the center area where the boarders of the second subarea are excluded as illustrated in FIG. 12B. The number, shape, direction, and depth of the grooves 1132 provided in the second subarea may be set by using the Helmholtz resonator equation so that the acoustic characteristics can have optimum values experimentally.

Figure 13:
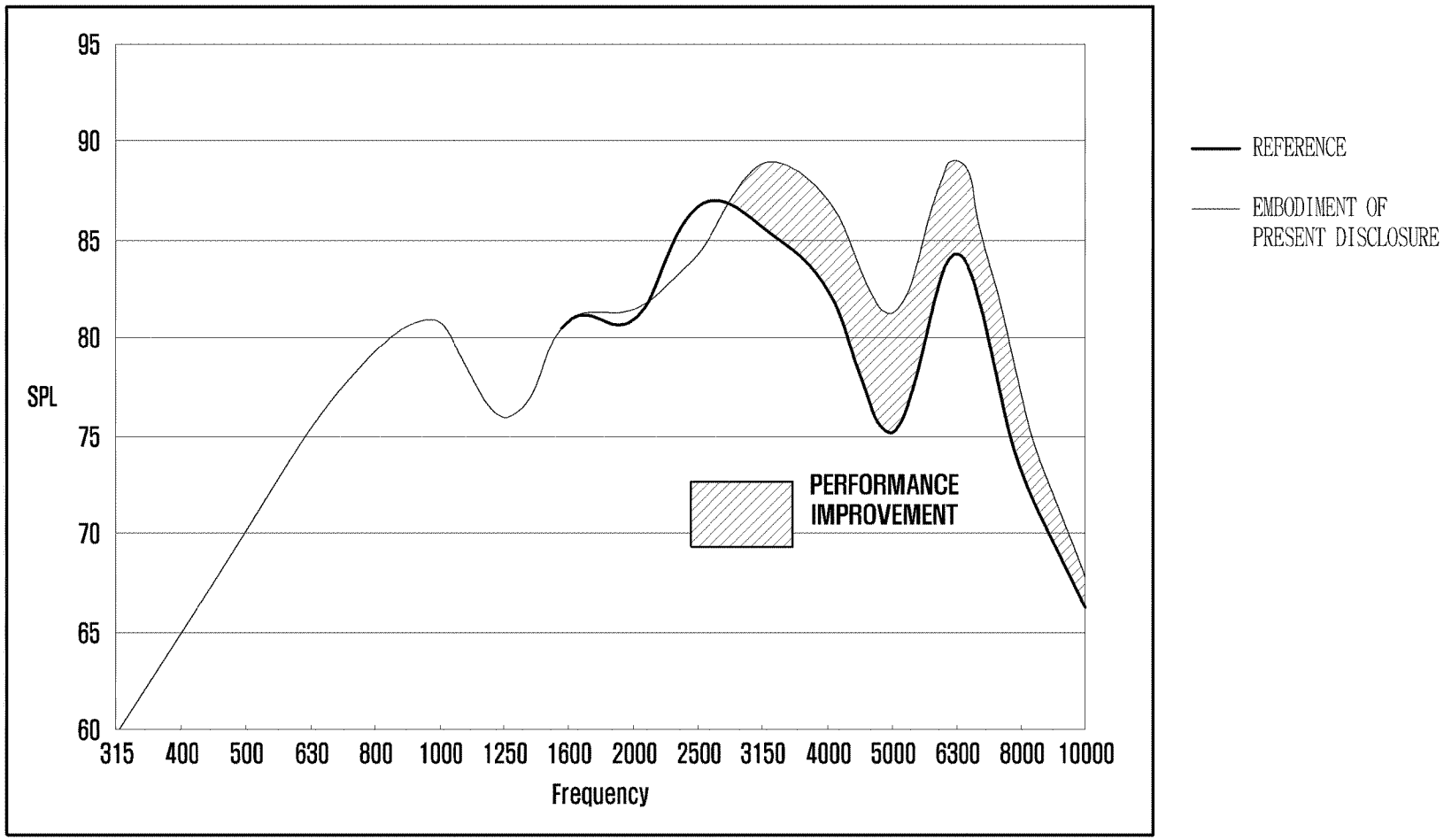
FIG. 13 is a graph illustrating an example acoustic characteristic deterioration of a speaker module according to addition of a waterproof member.

FIG. 13 is a graph illustrating an acoustic characteristic deterioration of a speaker module due to an addition of a waterproof member and an improvement in acoustic characteristics when using the construction of the example embodiments of the present disclosure.

With reference to FIG. 13, the side emission speaker device according to various embodiments of the present disclosure is designed so that a second substrate provided at an upper surface of a speaker has different thicknesses in different portions thereof, and thereby a sound pressure can be obtained similar to that of a conventional side emission speaker device even though a waterproof member is added. For example, according to various example embodiments of the present disclosure, it is known that an improved sound pressure can be secured in a relatively higher frequency band (for example, in a frequency band higher than 2.5 KHz) compared with the reference illustrated in FIG. 7B. Such a result of measurement is exemplary and the frequency band and the sound pressure may be shown differently according to the application of the Helmholtz resonator equation. For example, when manufacturing in practice a side emission speaker device, actual acoustic characteristics may differ according to the performance of a speaker module, and the shape and size of an enclosure case. The acoustic characteristics may differ slightly according to various embodiments; however, it is clear that various embodiments of the present disclosure can provide excellent acoustic characteristics by the second substrate being designed to have different thicknesses partially in comparison with the structure example shown in FIG. 7B, which generates deterioration of sound pressure in a high frequency band.

In all the aforementioned embodiments, it may be apparent to those skilled in the art that the components can be changed or modified in various ways. For example, the sound path of the electronic device may be formed at one of an upper enclosure case, a lower enclosure case, or their combinations.

As described above, various example embodiments of the present disclosure can provide a sound pressure similar to that of a conventional side emission speaker device by designing a second substrate to have different thicknesses partially when a waterproof member is added. Accordingly, an issue of deteriorating acoustic characteristics can be avoided even when a mechanism is added for a waterproof function.

While the disclosure has been illustrated and described with reference to certain example embodiments thereof, it will be understood by those skilled in the art that various changes in form and detail may be made therein without departing from the spirit and scope of the disclosure as defined by the appended claims.

What is claimed is:

1. An electronic device comprising:

a speaker module disposed in the electronic device;

wherein the speaker module comprises:

a first substrate, a speaker including a lower surface disposed on the first substrate, a waterproof member contacting at least one part of an upper surface of the speaker and at least one part of a first side surface of the speaker, and a second substrate contacting a second side surface of the speaker and overlapping an upper surface of the speaker;

wherein the second substrate comprises a first subarea spaced apart from the upper surface of the speaker by a first distance, the first subarea having a first thickness, and a second subarea spaced apart from the upper surface of the speaker by a second distance, the second subarea having a second thickness;

wherein a space between the waterproof member and the first subarea includes an acoustic emission hole configured to transfer a sound emitted by the speaker to the outside of the electronic device, and wherein the first thickness is less than or equal to the second thickness.

2. The electronic device of claim 1, wherein the first subarea corresponds to an end of the waterproof member covering a part of the upper surface of the speaker, and to a conduit area between a sound path and a sound reflection space located on the upper surface of the speaker; and the second subarea corresponds to the inside of the sound reflection space.

3. The electronic device of claim 1, wherein the first distance is greater than or equal to the second distance.

4. The electronic device of claim 1, wherein the first and second subareas of the second substrate comprise different materials from each other.

5. The electronic device of claim 4, wherein the first subarea comprises a metallic material and the second subarea comprises a plastic extrusion material.

6. The electronic device of claim 1, wherein the second substrate comprises at least one groove in the second subarea.

7. The electronic device of claim 6, wherein the groove is located at the rear surface portion of the second subarea facing the upper surface of the speaker.

8. The electronic device of claim 6, wherein the groove comprises a plurality of grooves arranged in substantially a center area of the second subarea excluding a peripheral border portion of the second subarea.

9. The electronic device of claim 1, wherein the second subarea facing the upper surface of the speaker has a greater area than an area of the first subarea facing the upper surface of the speaker.

10. An electronic device comprising:

a speaker module accommodated in the electronic device;

wherein the speaker module comprises:

a speaker, an enclosure case configured to surround at least one part of the speaker, and a waterproof member disposed in the enclosure case and disposed to cover a side surface and a part of an upper surface of the speaker;

wherein an upper substrate of the enclosure case facing the upper surface of the speaker includes at least two subareas, each subarea having a different thickness,.

wherein the enclosure case comprises:

a first substrate configured to accommodate at least one part of the speaker, and a second substrate of which at least one side surface extends from a side surface of the first substrate, at least a portion of the second substrate corresponding to an upper surface of the speaker;

wherein the second substrate comprises a first subarea spaced apart from the upper surface of the speaker by a first distance, the first subarea having a first thickness, and a second subarea spaced apart from the upper surface of the speaker by a second distance, the second subarea having a second thickness;

wherein a space between the waterproof member and the first subarea includes an acoustic emission hole configured to transfer a sound emitted by the speaker to outside of the electronic device, and wherein the first thickness is less than or equal to the second thickness.

11. The electronic device of claim 10, wherein the first subarea corresponds to an end of the waterproof member covering a part of the upper surface of the speaker, and to a conduit area between a sound path and a sound reflection space located on the upper surface of the speaker; and the second subarea corresponds to the inside of the sound reflection space.

12. The electronic device of claim 10, wherein the first distance is greater than or equal to the second distance.

13. The electronic device of claim 10, wherein the first and second subareas of the second substrate comprise different materials from each other.

14. The electronic device of claim 13, wherein the first subarea comprises a metallic material and the second subarea comprises a plastic extrusion material.

15. The electronic device of claim 10, wherein the second substrate comprises at least one groove in the second subarea.

16. The electronic device of claim 15, wherein the groove is located at a rear surface portion of the second subarea facing the upper surface of the speaker.

17. The electronic device of claim 15, wherein the groove comprises a plurality of grooves arranged in substantially a center area of the second subarea excluding a peripheral border portion of the second subarea.

* * * * *